United States Patent [19]

Journet

[11] 4,352,451

[45] Oct. 5, 1982

[54] CENTRIFUGAL DRIER

[75] Inventor: Gérard Journet, Hellemmes Lille, France

[73] Assignee: Fives-Cail Babcock, Paris, France

[21] Appl. No.: 190,740

[22] Filed: Sep. 25, 1980

[51] Int. Cl.[3] ..... B04B 7/00; B04B 11/06

[52] U.S. Cl. ..... 233/27; 127/19

[58] Field of Search ..... 233/1 C, 2, 27, 34, 233/45; 127/19

[56] References Cited

U.S. PATENT DOCUMENTS

| | | | |
|---|---|---|---|
| 3,647,135 | 3/1972 | Mercier | 233/2 X |
| 3,682,373 | 8/1972 | Mercier | 233/1 C |
| 3,989,185 | 11/1976 | Mercier | 233/27 |

*Primary Examiner*—Billy J. Wilhite

*Attorney, Agent, or Firm*—Kurt Kelman

[57] ABSTRACT

A centrifugal drier comprises a conical bowl mounted in a housing for rotation about a vertical shaft. A circular wall concentrically surrounds the bowl and separates the housing chamber into a first compartment receiving the liquid from the rotating bowl and a second compartment receiving the separated solids therefrom. A skirt surrounds an upper part of the bowl and is affixed thereto. An annular baffle is affixed to the circular wall and extends between the wall and a lower skirt part. The circular wall, the skirt and the baffle define an annular space in communication with the first chamber. Rotation of the bowl and skirt affixed thereto causes the liquid to be forced centrifugally from the bowl into the first chamber and liquid droplets to be suspended in an air current in the annular space. A fibrous mat is disposed in this space and surrounds the skirt to trap the suspended liquid droplets and permit the liquid to run by gravity into the first chamber.

7 Claims, 4 Drawing Figures

CENTRIFUGAL DRIER

The present invention relates to improvements in an apparatus for the continuous centrifugal separation of solids from a liquid and is particularly useful in sugar refineries for the drying of massecuites. Apparatus of this type is more fully disclosed, for example, in U.S. Pat. Nos. 3,682,373 and 3,989,185.

Such apparatus comprises an upwardly and outwardly tapering conical bowl having an upper rim and an inner surface covered by a screen. A housing surrounds the bowl and defines a chamber, and a vertical shaft is mounted in the housing and supports the bowl for rotation thereabout. A circular wall concentrically surrounds the bowl and separates the housing chamber into a first compartment receiving the liquid from the rotating bowl and a second compartment receiving the separated solids therefrom. A suspension of solids in the liquid is delivered into the bowl for drying and is spread over the screen by centrifugal force during rotation of the bowl, this force causing the solids retained on the screen to be displaced upwardly over the upper bowl rim into the second chamber while the liquid passes through the screen and flows through discharge nozzle means at the upper rim into the first chamber.

The rotation of the bowl causes a current of air to flow from the interior of the bowl through the discharge nozzle means into the first compartment whence it passes into the second compartment through an annular gap between the upper rim of the bowl and the upper edge of the circular wall. Droplets of liquid are suspended in this current of air and are, therefore, entrained into the second chamber where the solids are received from the bowl. This obviously impairs the drying of the solids, which is undesirable in the use of the apparatus for drying massecuites, for example, since the humidification of the sugar crystals received in the second compartment causes agglomerations and/or deposits on the walls of the compartment.

Various efforts have, therefore, been made to overcome this disadvantage and to separate the first and second compartments fluid-tightly so as to eliminate the air current from passing from the first into the second compartment. In the above-identified patents, for example, it has been proposed to provide a downwardly and outwardly tapering conical skirt surrounding the upper part of the bowl, the skirt having an upper part affixed to the bowl and a lower part. One or more annular baffles may be affixed to the circular wall, the baffles having an inner edge closely spaced from the skirt. Although such baffle means reduce the circulation of air loaded with liquid droplets suspended therein, the system is not very efficient.

It has also been proposed to isolate the space defined between the circular wall and the skirt from the second compartment by a hydraulic seal. According to this solution to the problem, a baffle affixed to the circular wall and associated with the skirt comprises a part which is frusto-conical, the apex angle of the frusto-conical part being almost 180° and the upper and inner edge of the part being disposed slightly above the lower edge of the skirt. In this structure, the liquid collected on the skirt at the discharge end of the bowl is projected in a film over the lower face of the baffle part and a hydraulic joint is provided between the lower and outer edge of the baffle part and the circular wall. When the liquid is relatively viscous, this gives satisfactory results but with more fluid liquids, the fluid tightness is not so good, probably because the liquid film on the upper face of the baffle part is again dispersed in fine droplets by the air currents generated by the rotation of the skirt instead of returning into the first compartment through a gap between the outer edge of the baffle part and the circular wall and hydraulic joint.

It is the primary object of this invention to improve on these attempted solutions to the problem of preventing liquid droplets from entering the second compartment in which the solids are received and to provide a tight seal even when the liquid in the first compartment is of low viscosity.

In an apparatus for the continuous centrifugal separation of solids from liquids of the indicated type, the above and other objects are accomplished with an annular baffle affixed to the circular wall and extending between the circular wall and the lower skirt part, the circular wall, the skirt and the baffle defining an annular space in communication with the first compartment, rotation of the bowl and skirt affixed thereto causing the liquid to be forced centrifugally from the bowl into the first compartment and droplets of the liquid to be suspended in an air current in the annular space, and a fibrous mat disposed in the annular space and surrounding the skirt, the mat being arranged to trap the suspended liquid droplets and permit the trapped liquid to run by gravity into the first compartment.

The above and other objects, advantages and features of the invention will become more apparent from the following detailed description of certain now preferred embodiments thereof, taken in conjunction with the accompanying drawing wherein FIG. 1 is a fragmentary side view, largely in axial section, of an embodiment of a centrifugal drier according to the present invention;

Figure 1:
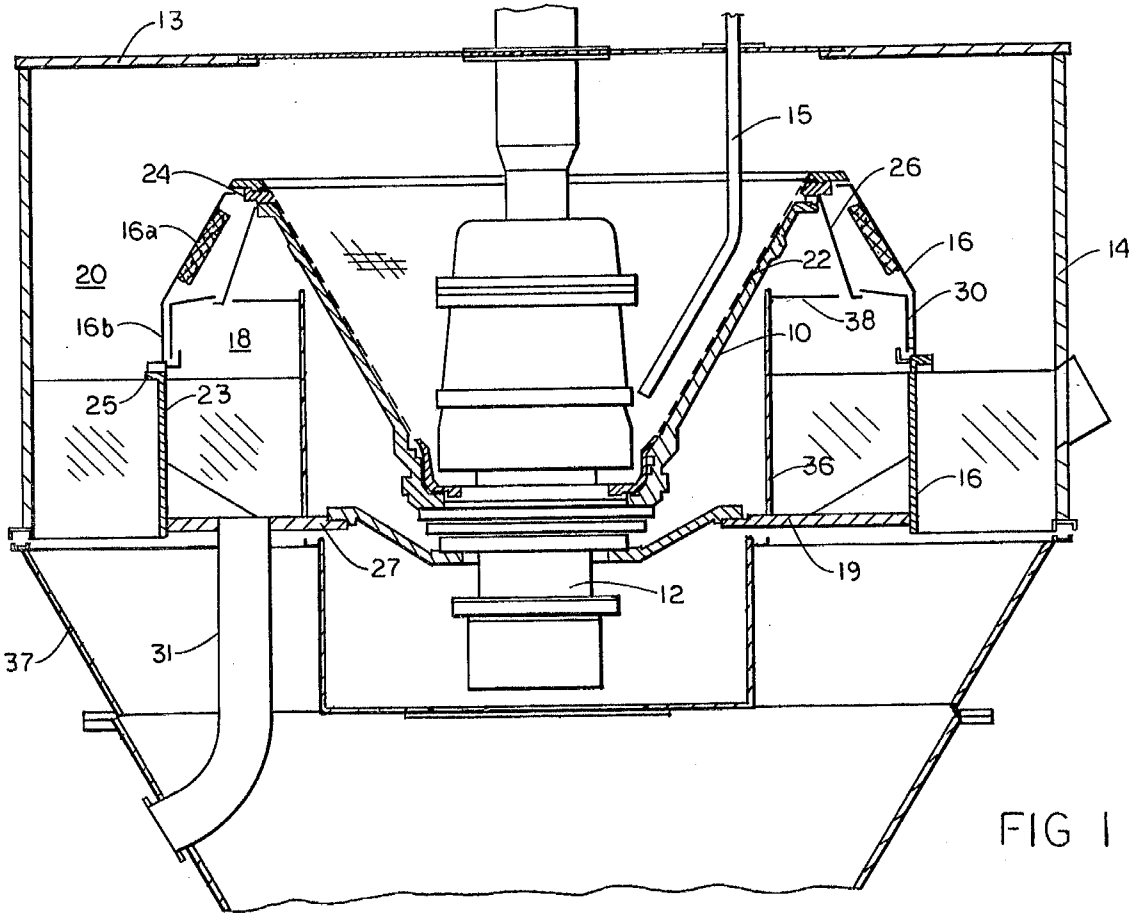
Figure 2:
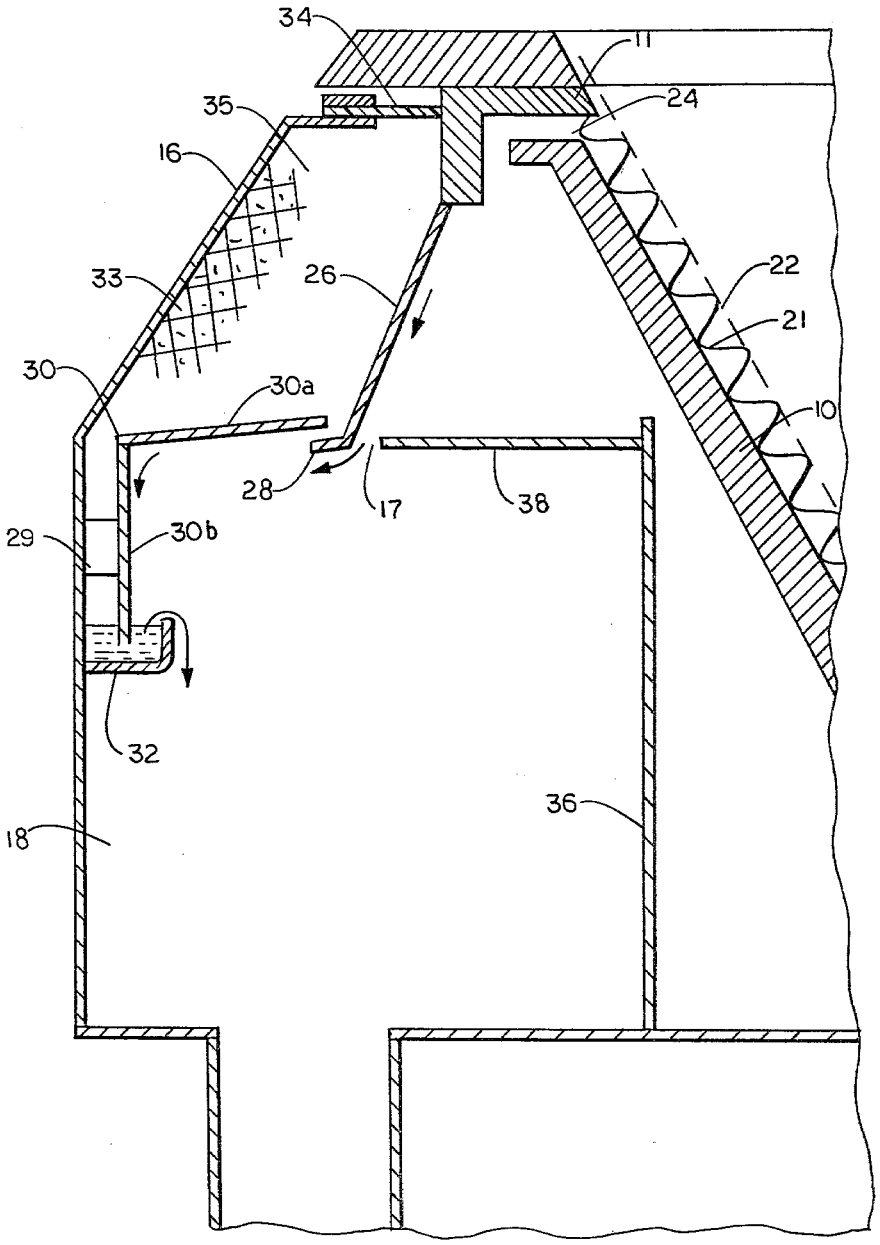
FIG. 2 is a like view of a portion of the drier, on an enlarged scale.

Referring now to the drawing, wherein like reference numerals designate like parts operating in a like manner in all figures, FIGS. 1 and 2 illustrate a generally known type of apparatus for the continuous centrifugal separation of solids from a liquid. This apparatus comprises upwardly and outwardly tapering conical bowl 10 having upper rim 11 and an imperforate wall. Cylindrical housing 14 surrounds bowl 10 and defines a chamber. Vertical shaft 12 is mounted in housing 14 and supports bowl 10 for rotation thereabout. The housing chamber is closed on top by cover 13 which carries delivery pipe 15 for feeding a liquid suspension of solids into bowl 10 for drying. Circular wall 16 concentrically surrounds bowl 10 and separates the housing chamber into first compartment 18 receiving the liquid from the rotating bowl and second compartment 20 receiving the separated solids therefrom. In the illustrated embodiment, wall 16 has a frusto-conical upper part **16*a* and a cylindrical lower part 16*b***.

The inner surface of the imperforate bowl wall is lined with screen 22 which is suitably spaced from the bowl wall by spacing element 21. On rotation of bowl 10, centrifugal force will cause the solids retained on the screen to be displaced upwardly and radially outwardly over upper bowl rim into compartment 20. This force will simultaneously cause the liquid to pass through screen 22 into the space between the screen and the imperforate bowl wall, to be ejected through discharge nozzle means 24, i.e. openings in the upper rim of the bowl, into compartment 18.

Skirt 26 surrounds the upper part of bowl 10 and has an upper part affixed to the upper bowl part. In the illustrated embodiment, this skirt is a downwardly and outwardly tapering frusto-conical imperforate wall element whose lower part has an annular ledge 28.

Annular baffle 30 is affixed to circular wall 16 and extends between the circular wall and the lower skirt part. In the embodiments illustrated in FIGS. 1 to 3, this baffle is comprised of a first part 30*a* which is frusto-conical and a support part 30*b* which is cylindrical, a series of brackets or braces 29 being provided to attach cylindrical baffle part 30*b* to lower cylindrical wall part 16*b*, the spacing between the interconnected pairs being small. The apex angle of frusto-conical baffle part 30*b* is very large, i.e. almost 180° to form a very slight incline, and the inner edge of this baffle part extends a slight distance above ledge 28 of skirt 26 to form a gap. Circular wall 16, skirt 26 and baffle 30 define annular space 35 in communication with first compartment 18 through the gap between the inner edge of baffle part 30*a* and skirt ledge 28. Rotation of bowl 10 and skirt 26 affixed thereto causes the liquid to be forced centrifugally from the bowl through discharge nozzle means constituted by radial bore 24 into first compartment 18 and droplets of the liquid to be suspended in an air current in annular space 35, the course of the liquid flow being indicated by short arrows.

Fibrous mat 33 is disposed in annular space 35 and surrounds skirt 26, the mat being arranged to trap the suspended liquid droplets and permit the trapped liquid to run by gravity into first compartment 18. The mat is constituted by entangled fibers and may be a web of knitted or woven fibers, for example. The fibers may be metallic or of a synthetic resin and they are loosely enough woven or knitted to permit the liquid droplets to penetrate readily into the mat and to be entrapped therein. The thickness of the mat is sufficient to protect the entrapped liquid from the air current generated by the rotating skirt, a thickness of about 1 to 2 cm having been found satisfactory.

In the embodiment of FIG. 2, fibrous mat 33 is attached to circular wall 16 and extends between an upper edge thereof and baffle 30. The entrapped liquid runs by gravity from the mat into first compartment 18 through a gap between the baffle and the circular wall, more particularly cylindrical baffle part 30*b* and lower wall part 16*b*.

As shown in FIG. 2, a fluid-tight joint consisting of annular rubber gasket 34 separates annular space 35 from second compartment 20. The rubber gasket is affixed to the upper edge of circular wall 16.

According to a preferred feature of this invention, screening means 36, 38 separates first compartment 18 from bowl 10 to reduce the air current in the compartment induced by the rotation of the bowl. The illustrated screening means includes cylindrical sleeve 36 concentrically surrounding the bowl below the upper rim thereof and annular wall 38 affixed to sleeve 36. The annular wall extends between the sleeve and skirt 26 substantially coplanar with the lower edge of the skirt, leaving gap 17 therebetween to permit the liquid to flow into first compartment 18.

In operation, and during rotation of bowl 10, the liquid passes through screen 22 and is ejected through discharge nozzle means 24 at the upper edge of the bowl, to flow along skirt 26 through gap 17, the centrifugal force causing the film of liquid to continue flowing horizontally along the lower surface of baffle part 30*a* and then down the inner surface of baffle part 30*b*. The lower end of cylindrical baffle part 30*b* is immersed in annular trough 32 which also receives the liquid running down from mat 33. The trough is affixed to lower wall part 16*b* and the liquid therein forms a hydraulic joint and finally overflows into compartment 18.

The high-speed ejection of the liquid through gap 17 creates a slight depression in annular space 35 while the current of air engendered by the rotation of bowl 10 creates a superatmospheric pressure in compartment 18. This low pressure in annular space 35 and high pressure in compartment 18 causes some liquid to be displaced into the annular space from the compartment through the gap between baffle 30 and skirt 26. A portion of this liquid in annular space 35 is pushed by the air current in the space into the annular gap between baffle part 30*b* and wall part 16*b* where it runs into trough 32. Any liquid droplets suspended in the air current in compartment 18 are prevented from passing into the gap by the hydraulic joint formed in trough 32.

The other portion of the liquid, which has penetrated into annular space 35, is atomized into fine droplets by the air current which the rotation of bowl 10 and skirt 26 creates in the space. These droplets are entrained by the air current towards circular wall 16 where they are entrapped by and in mat 33. The entrapped liquid is protected from the air current by the mat and runs by gravity into the gap between the baffle and the circular wall to be received in trough 32.

As shown in FIG. 1, the lower part of first compartment 18 may be formed by a circular side wall 23 which is flanged to circular wall 16 at 25 and has bottom 27. Liquid outlet pipe 31 leads from the bottom of compartment 18 through foundation 37 on which the drier is mounted.

Figure 3:
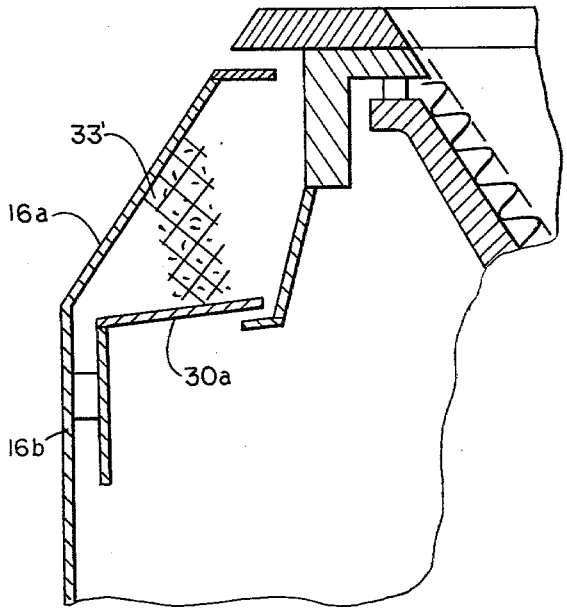
FIG. 3 is a view similar to that of FIG. 2, showing a modification.

In the modification of FIG. 3, fibrous mat 33′ has its upper edge in contact with upper part 16*a* of the circular wall and the lower edge in contact with annular baffle part 30*a*, the ends of the mat being affixed to these parts and the mat extending through the annular space. In this modified structure, the hydraulic joint at the bottom of the baffle has been eliminated since any liquid droplets returning from compartment 18 into annular space 35 will be entrapped by mat 33′ which extends across the annular space.

Figure 4:
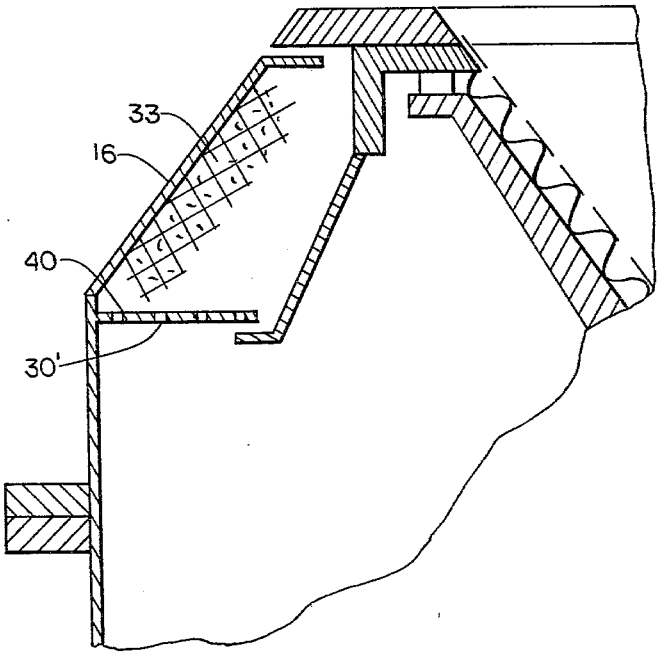
FIG. 4 is also a similar view, showing another modification.

In the modification of FIG. 4, the arrangement of mat 33 is the same as in FIG. 2 but the baffle consists of annular wall 30′ affixed to circular wall 16. Close to its outer periphery ajacent the circular wall, baffle wall 30′ defines a series of ports 40 through which the liquid entrapped in mat 33 runs by gravity into chamber 18. If desired, the mat could be arranged in the manner shown in FIG. 3.

While the present invention has been described and illustrated in connection with certain now preferred embodiments, it will be understood that many variations and modifications may occur to those skilled in the art, particularly after benefitting from this teaching, without departing from the spirit and scope of the invention as defined in the appended claims.

What is claimed is:

1. An apparatus for the continuous centrifugal separation of solids from a liquid, which comprises (a) an upwardly and outwardly tapering conical bowl having an upper rim, (b) a housing surrounding the bowl and defining a chamber, (c) a vertical shaft mounted in the housing and supporting the bowl for rotation thereabout, (d) a circular wall concentrically surrounding the bowl and separating the housing chamber into a first compartment receiving the liquid from the rotating bowl and a second compartment receiving the separated solids therefrom, (e) a skirt surrounding an upper part of the bowl, the skirt having an upper part affixed to the upper bowl part and a lower part, (f) an annular baffle affixed to the circular wall and extending between the circular wall and the lower skirt part, (1) the circular wall, the skirt and the baffle defining an annular space in communication with the first compartment, rotation of the bowl and skirt affixed thereto causing the liquid to be forced centrifugally from the bowl into the first compartment and droplets of the liquid to be suspended in an air current in the annular space, and (g) a fibrous mat disposed in the annular space and surrounding the skirt, the mat being arranged to trap the suspended liquid droplets and permit the trapped liquid to run by gravity into the first compartment.

2. The centrifugal separation apparatus of claim 1, wherein the mat is constituted by a web of knitted fibers.

3. The centrifugal separation apparatus of claim 1, wherein the mat is constituted by a web of woven fibers.

4. The centrifugal separation apparatus of claim 1, wherein the fibrous mat is attached to the circular wall and extends between an upper edge thereof and the baffle.

5. The centrifugal separation apparatus of claim 1, wherein the fibrous mat has an upper and a lower edge, the upper edge of the mat being in contact with an upper part of the circular wall and the lower edge of the mat being in contact with the baffle.

6. The centrifugal separation apparatus of claim 1, wherein the circular wall has an upper edge, and further comprising an annular fluid-tight member arranged between the upper rim of the bowl and the upper wall edge.

7. The centrifugal separation apparatus of claim 1, further comprising means for separating the first compartment from the bowl, the separating means including a cylindrical sleeve concentrically surrounding the bowl below the upper rim thereof and an annular wall affixed to the sleeve, the annular wall extending betwen the sleeve and the skirt substantially coplanar with the lower edge of the skirt.

* * * * *